US007131598B2

(12) United States Patent
Ratnik

(10) Patent No.: US 7,131,598 B2
(45) Date of Patent: Nov. 7, 2006

(54) SNOW-GUN

(75) Inventor: H. Ronald Ratnik, Pittsford, NY (US)

(73) Assignee: Ratnik Industries, Inc., Victor, NY (US)

( * ) Notice: Subject to any disclaimer, the term of this patent is extended or adjusted under 35 U.S.C. 154(b) by 0 days.

(21) Appl. No.: 10/958,053

(22) Filed: Oct. 4, 2004

(65) Prior Publication Data

US 2006/0071091 A1 Apr. 6, 2006

(51) Int. Cl.
*F25C 3/04* (2006.01)
*B05B 7/04* (2006.01)

(52) U.S. Cl. ..... 239/14.2; 239/433; 239/418; 239/523; 239/599

(58) Field of Classification Search ..... 239/14.2, 239/433, 419, 424, 434, 426, 418, 523, 524, 239/597, 599
See application file for complete search history.

(56) References Cited

U.S. PATENT DOCUMENTS 2,125,445 A * 8/1938 Holveck ..... 239/599
3,647,147 A * 3/1972 Cook ..... 239/599
3,829,013 A * 8/1974 Ratnik ..... 239/14.2
4,793,554 A * 12/1988 Kraus et al. ..... 239/2.2
5,090,619 A * 2/1992 Barthold et al. ..... 239/14.2
6,402,062 B1 * 6/2002 Bendig et al. ..... 239/599

* cited by examiner

*Primary Examiner*—David A. Scherbel
*Assistant Examiner*—Seth Barney
(74) *Attorney, Agent, or Firm*—Warren W. Kurz

(57) ABSTRACT

A snow-gun for producing man-made snow from a combination of compressed air and water features a new nozzle configuration for discharging a mixture of water-particles and air into the surrounding atmosphere. Such nozzle is provided with an elliptically-shaped discharge port having a transverse cross-section that gradually expands in size in the direction in which the air and water particles are discharged from said nozzle. Preferably, the area of the elliptical port changes non-linearly through the front wall of the nozzle, whereby water particles exiting the gun through the nozzle port are less likely to collide with the side walls of the port or with each other before reaching the relatively cold ambient atmosphere.

4 Claims, 4 Drawing Sheets

SNOW-GUN

BACKGROUND OF THE INVENTION

1. Field of the Invention

The present invention relates to the "art" of making snow. More particularly, it relates to improvements by which conventional snow-making devices, i.e., "snow-guns", are rendered more efficient in terms of requiring less compressed air to produce a given amount of snow.

2. The Prior Art

In the commonly assigned U.S. Pat. No. 3,829,013 issued to H. Ronald Ratnik, a snow-gun is disclosed that is adapted to produce a multitude of ice crystals resembling natural snow from a mixture of pressurized water and compressed air. Such a device (shown in FIGS. 1 and 2) operates by injecting water from a pressurized source (e.g., between 60 and 120 pounds per square inch (PSI)) radially inwardly through a plurality of equally spaced holes circumferentially located in the wall of a cylindrical conduit through which air is flowing from a compressed air source at a high flow rate (e.g., between 400 and 900 cubic feet per minute (CFM)). The respective holes in the conduit wall are typically between ¼ and ⅛ inch in *diameter*, and each hole serves to *break-up* the water passing through it into relatively small *droplets*, between 100 and 300 microns in diameter. The air rushing through the conduit serves to carry the droplet and water mixture into contact with a concave anvil or "cup" axially located on the longitudinal axis of the conduit, a short distance from the outlet end of the conduit. Upon impacting the cup, the water droplets are further broken-up and reduced in size (e.g., to between 50 and 100 microns). Upon reflecting from the concave surface of the cup, the atomized mixture of air and water enters a mixing chamber within the forward portion of the gun. The mixing chamber is of significantly larger volume than the cup, and the water particles entering the mixing chamber are cooled appreciably by the cooler ambient temperature therein. The water particles are then further cooled as they exit the mixing chamber and expand into the surrounding atmosphere through a circular or oval-shaped aperture formed in a nozzle carried by the forward-most wall of the snow gun.

For decades, snow-guns of the type described above have been used commercially at ski resorts and the like for supplementing the amount of natural snow-fall received at these areas. Indeed, it is not uncommon for such snow-guns to provide the majority of snow on the ground at these resorts. In addition to the initial cost of the snow-guns, the most significant expense in making snow "artificially" is the cost to the compressed-air component. The need to transport compressed air up a mountain side from a base unit situated at the bottom of the mountain to a multitude of snow-guns situated at various levels on the mountain readily translates into a certain amount of horsepower which, in turn, translates into Kilowatt hours of electrical energy and, hence, financial outlay. Thus, any significant reduction in the amount of compressed air required to produce a nominal amount of snow is greeted with great enthusiasm by the owners and operators of these facilities.

As indicated above, snow-making is more of an art-form than science. Why a particular snow-gun design "works" well (or poorly) is not totally understood. Where, during the design phase, major modifications are expected to enhance the snow-making efficiency of a snow-gun, actual testing in the field has often proven the designers to be wrong. And vice-versa, i.e., where seemingly minor or trivial changes in a design are expected to have little or no effect on performance and efficiency of a given snow-gun, field-testing has yielded totally unexpected significant increases in output and efficiency of the snow-gun. The invention described herein is an example of the latter situation.

SUMMARY OF THE INVENTION

In view of the foregoing discussion, an important object of this invent is to enhance the snow-making efficiency of snow-guns of the type described above.

In accordance with the present invention, it has been discovered that a seemingly minor change to the shape of the nozzle component of a snow-gun of the above type gives rise to a remarkable and totally unexpected increase in the snow-making efficiency of the snow-gun, an efficiency increase by as much as 75% or more. The discharge port in the nozzle comprising the snow-making apparatus of the invention is preferably elliptical (oval) in shape and, in contrast to similar nozzles, the area of the elliptical opening expands in size through the thickness of the nozzle wall. As a result of this expansion in size, the water particle/air mixture passing through the nozzle discharge port passes through an annular cusp which allows the mixture to more immediately expand into the atmosphere, as compared with the prior art nozzles in which the nozzle opening is defined by a relatively long (e.g., 2.0 cm) bore hole of constant transverse cross-sectional area. In such a prior art nozzle, it is suspected that the water particles passing through the nozzle opening actually recombine with each other to form larger water particles which, of course, are more difficult to convert to ice crystals. In the nozzle component comprising the snow-gun of the invention, it appears that the relatively small water particles confined by the mixing chamber of the snow-gun are able to leave the snow-gun without substantially changing in size; thus, they more readily reach the transition temperature required for them to convert to ice crystals.

Thus, in accordance with a preferred embodiment of the invention, an improved snow-gun is provided of the type comprising: (a) a first conduit comprising a first cylindrical wall defining a first passageway therein, such first conduit having (i) an entrance aperture at one end for admitting air from a compressed air source into the first passageway, (ii) an exit aperture at the opposite end through which air passing through the first passageway can exit the first conduit, and (iii) a plurality of spaced holes circumferentially located in the first cylindrical wall at a location proximate the exit aperture of the first conduit; (b) a second conduit comprising a second cylindrical wall concentrically positioned about and spaced from the first cylindrical wall of the first conduit to define a second passageway between the two cylindrical walls, such second cylindrical wall having a port therein for introducing water into the second passageway from a pressurized water source, such second passageway communicating with the first passageway only via the holes formed in the first cylindrical wall, whereby pressurized water within said second passageway can be injected into an air stream passing through the first passageway; (c) a housing defining a mixing chamber connected to the first and second conduits for receiving an expanding mixture of air and water particles from the first passageway; (d) a blocking member positioned within the mixing chamber at a position to break-up and thereby reduce the size of water particles entering the mixing chamber; and (e) a nozzle member mounted in a forward wall of the mixing chamber housing, such nozzle having a discharge port through which air and water particles are discharged into the atmosphere. In accordance with the present invention, the cross-sectional area of the discharge port gradually expands in size in the direction in which the air and water particles are discharged through the nozzle opening. Preferably, the discharge port is oval in shape, and the transverse cross-sectional area of the port varies non-linearly with the displacement through the nozzle opening, whereby the water particles discharged from the nozzle are prevented from contacting the port wall nozzle opening until they have passed a substantial distance from the smallest cross-sectional area of the port opening.

The invention and its advantages will be better understood from the ensuing detailed description of preferred embodiments, reference being made to the accompanying drawings in which like reference characters denote like parts.

DETAILED DESCRIPTION OF PREFERRED EMBODIMENTS

Figure 1:
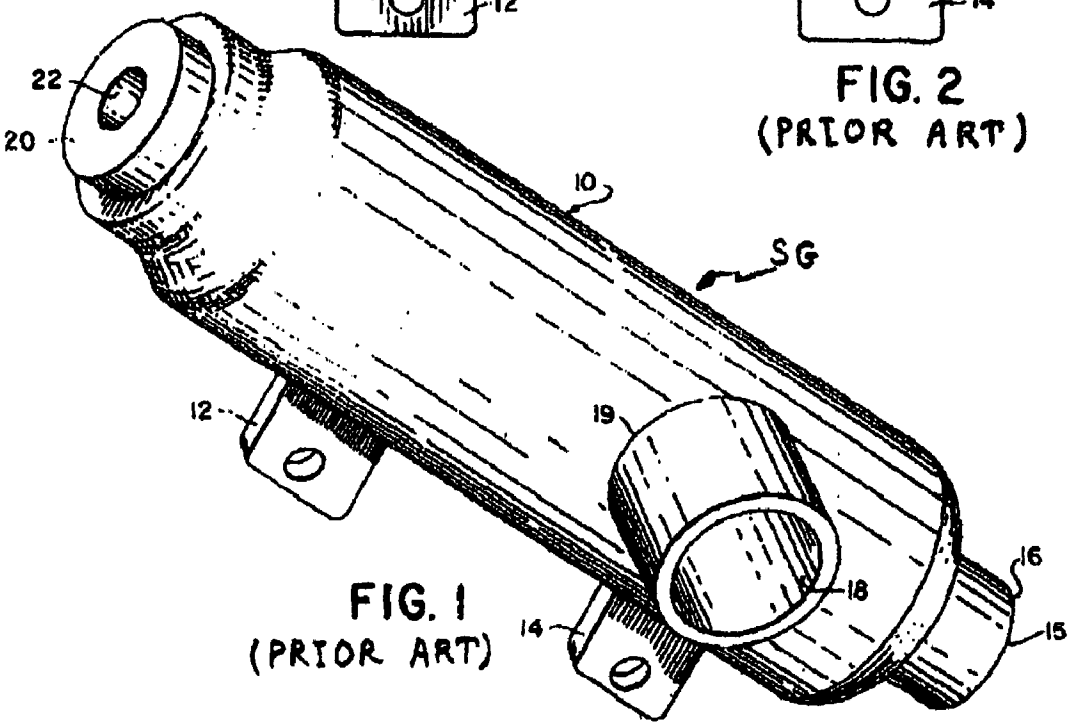
FIG. 1 (PRIOR ART)

Referring now to the drawings, FIG. 1 is a perspective view of a conventional snow-gun SG of the type briefly described above and more fully disclosed in the afore-noted U.S. Pat. No. 3,829,013. As described in this patent, such a snow-gun operates to project a plume of man-made snow by injecting relatively small streams of water into a fast-moving air stream that flows axially through the snow-gun housing from a source of compressed air. As explained in the patent, the compressed air stream flowing through the snow-gun acts in concert with certain internal structure of the snow-gun to break-up the injected water streams into relatively small water particles that are readily converted to ice crystals upon being projected into the relatively cold ambient temperature of the surrounding atmosphere. The compressed air stream further serves to rapidly lower the temperature of the injected water streams and, after particle formation, to propel such water particles outwardly, and usually upwardly, into the air to enhance the "hang-time" of the particles and, hence, the time available for crystallization of the water particles to occur.

Figure 2:
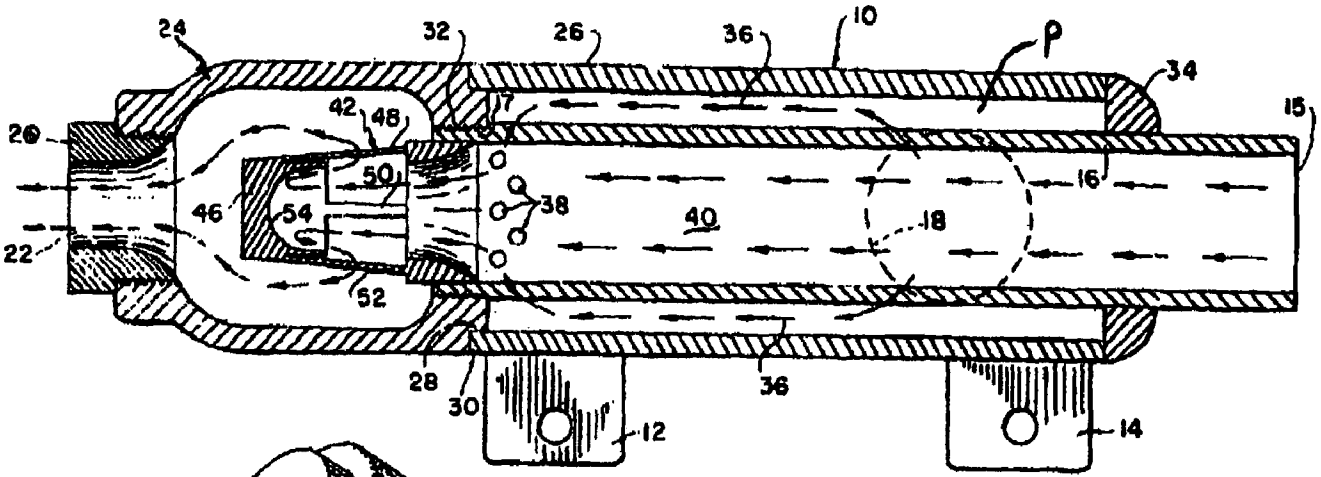
FIG. 2 (PRIOR ART)
FIGS. 1 and 2 are perspective and cross-sectional illustrations of a snow-gun structured in accordance with the prior art.

Referring additionally to the cross-sectional illustration of FIG. 2, the snow gun of the prior art comprises a generally cylindrical housing 10 (typically made of cast aluminum components) having a pair of downwardly-depending mounting tabs 12 and 14 by which the snow-gun may be releasably connected to a sled or tower so that the position of the snow-gun relative to a region in which snow is to be made can be easily changed, and/or the direction in which snow is projected is adjustable. A portion of the tubular housing 10 concentrically surrounds an internal cylindrical conduit 16 having an inlet end 15 that is adapted to be connected to a source of compressed air (not shown). Extending laterally from the side of tubular housing 10 is a water coupling 19 having an inlet 18 through which water, under pressure, can be introduced into an annular passageway P defined by the outer surface of the compressed air conduit 16 and the inner surface of that portion of the tubular housing 10 that surrounds the compressed air conduit 16. Extending from the forward end of housing 10 is a snow-discharge nozzle 20 (typically made of brass) having a cylindrical bore 22 through which a mixture of air and cooled water particles is projected into the atmosphere where the water particles further cool very rapidly to form ice crystals (i.e., snow).

As is more clearly shown in FIG. 2, the tubular housing 10 is formed by the union of a cylindrical housing 24 of a mixing chamber (discussed below), and a cylindrical sleeve 26 that surrounds the end portion of the compressed air conduit 16. At their mating ends, the outer wall of the mixing chamber housing 24 is provided with a circumferential notch 28 that receives the end 30 of cylinder 26. At this union, the mixing chamber and cylinder 26 are welded together. An internal surface 32 of the mixing chamber housing is threaded to receive the threaded end 17 of the compressed air conduit 16. An end cap 34 is welded to the free end of sleeve 26, as well as to the outer wall of conduit 16, thus sealing the inlet end of passageway P. At the discharge end of the snow-gun, nozzle 20 is threaded into the forward wall of the mixing chamber housing 24.

Still referring to FIG. 2, a plurality of openings (circular holes) 38 is formed circumferentially in the wall of the compressed air conduit 16, in the vicinity of the threaded end thereof. These openings provide communication between passageway P and the interior of conduit 16. Thus, when water under pressure is introduced into passageway P through the water coupling 19, each of the openings 38 operates to produce a stream water or spray of relatively large water particles (depending on the hole diameters) that is directed inwardly into the interior of conduit 16. As also shown in FIG. 2, a flow-blocking member 42 is welded to the threaded end of cylinder 16. Such blocking member comprises a concave cup 46 which is supported by the end of conduit 16 and by a plurality of ribs 48, 50 and 52 so that the center of the concave surface 54 of cup member 46 is positioned on the longitudinal axis of the cylindrical housing 10. Thus, concave surface 54 is positioned in the path of the air/water mixture passing through the threaded outlet end of conduit 16.

In operation, compressed air is introduced into the interior 40 of conduit 16 through its inlet end 15. At the same time, water is introduced into passageway P via coupling 19. The water pressure is typically between 60 and 120 pounds-per square inch (PSI), and the air flow rate is typically between 400 and 900 cubic feet per minute. When the water flow (indicated by the arrows 36) reaches the forward end of passageway P, it passes through each of the plurality of the circumferentially-positioned holes 38 to produce a like plurality of water sprays that are injected into the fast moving compressed air stream in conduit 16. Upon impacting the injected water steams, the compressed air stream operates to break-up the water streams into relatively small particles which are carried by the air flow into contact with the concave surface 54 of the blocking member. Upon striking surface 54, the water particles are further reduced in size, and an umbrella of water particles having the general shape of surface 54 is formed adjacent to surface 54. The continuously flow mixture of air and water particles exiting from conduit 16 strikes this umbrella of water particles and reduces the water particle sizes even further. Upon forming part of the afore-mentioned umbrella of water particles, the water particles and compressed air mixture enters the interior of the mixing chamber housing 24, whereupon the mixture expands and thereby appreciably cools the water particles. The compressed air in the snow-gun then propels the cooled water particles through the cylindrical bore hole 22 in nozzle 20 and into the awaiting atmosphere, whereupon the water particles further cool and eventually crystallize into snow.

While the snow-gun apparatus described above has operated effectively for decades in producing massive amounts of snow at ski resorts and the like, it has been found that substantial improvements can still be made in the snow-making efficiency of such snow-guns. The snow-making efficiency is often defined in terms of the amount of compressed air needed to convert a given flow rate of water to snow. As noted above, the most significant cost by far in making snow is the compressed air component, and any design change or modification that significantly reduces the amount of compressed air needed for snow-making is always well-received by the user.

Referring again to FIGS. 1 and 2, the discharge nozzle 20 is shown as having a cylindrical bore of substantial length, typically about 2.0 cm., and of substantial diameter, typically about 3.0 cm. It is speculated that, during the discharge of water particles and compressed air through this circular bore hole, many of the water particles repeatedly interact with other water particles of the mixture, perhaps due to the "collimating" effect of the bore hole; i.e., due to the randomness in the direction of water particles in the mixing chamber 60, many water particles will strike the interior wall of the discharge opening and be re-directed back towards the other water particles being blown through the nozzle by the combined pressures of the compressed air and water. Whatever the mechanism, during such interaction, the respective volumes of the interacting particles can combine to form larger water particles that are more difficult to crystallize into snow. When this occurs, the consistency of the snow becomes wetter, i.e., more laden with water. The technical solution to a "wet snow" problem has always been to reduce the amount of water applied to the gun which, in turn, automatically increases the amount of compressed air that the snow-gun uses. While this solution will, indeed, rectify the problem, it has the adverse effects of (a) reducing the snow-making efficiency of the snow-gun, requiring more compressed air to produce snow of a desired consistency, and (b) reducing the rate of snow-making, thereby requiring the snow-guns to operate longer to produce a desired amount of snow.

Figure 3:
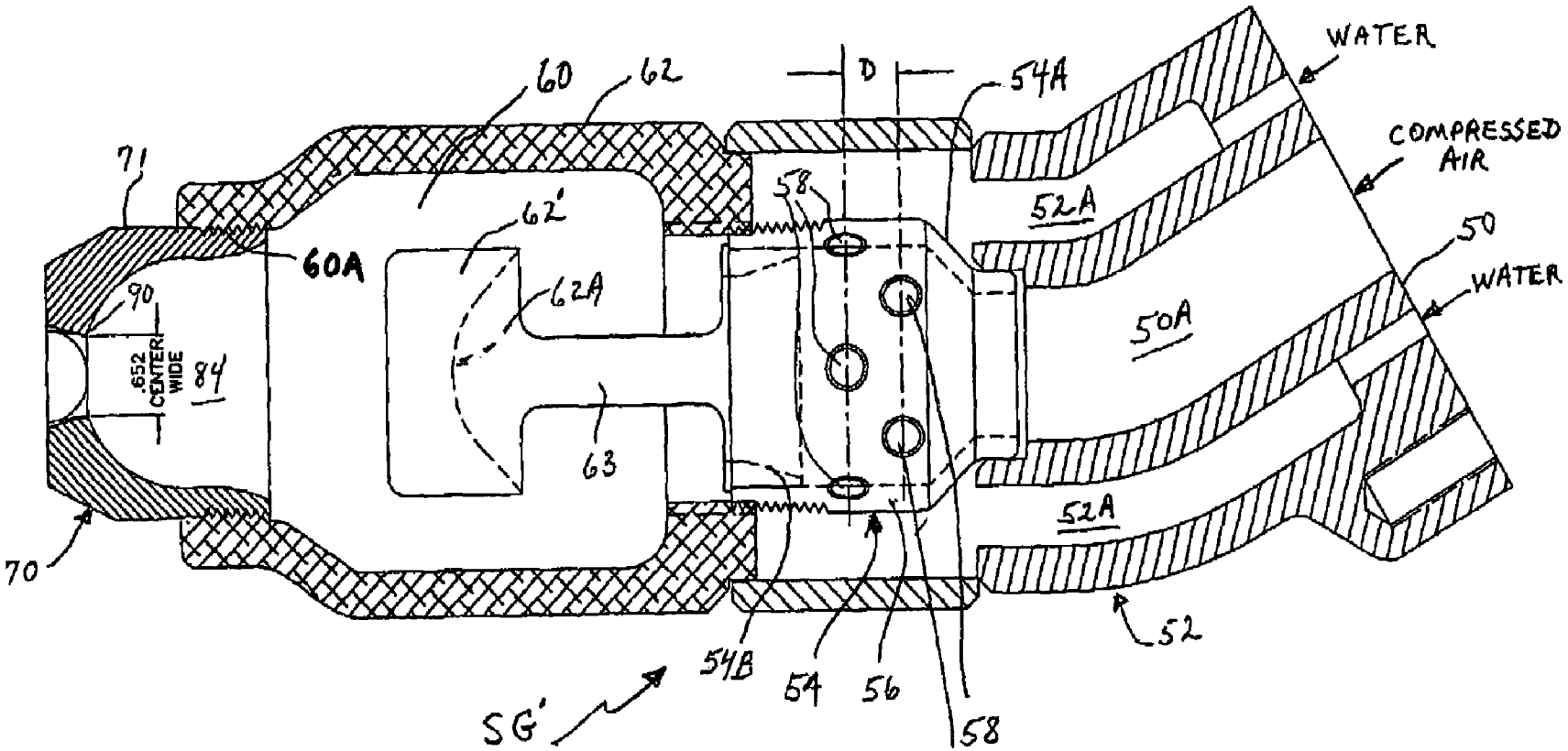
FIG. 3 is a cross-sectional illustration of a snow-gun structured in accordance with a preferred embodiment of the invention.
Figure 4A:
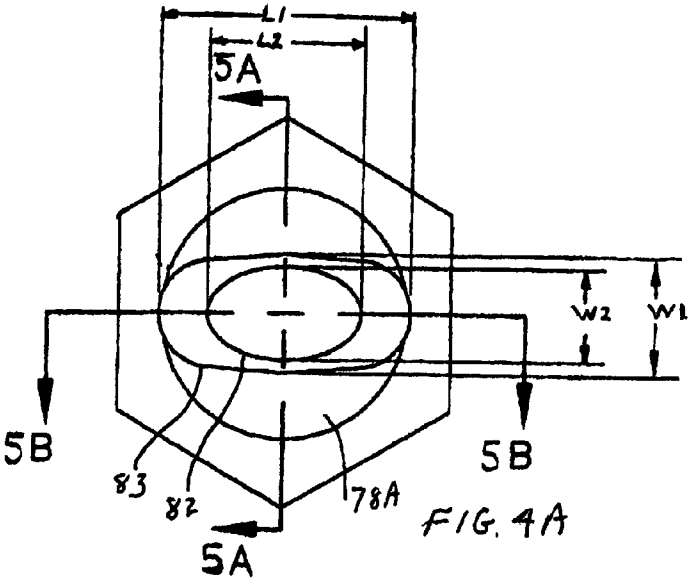
FIGS. 4A and 4B are front and side views of a preferred nozzle comprising the snow-gun apparatus shown in FIG. 3.
Figure 4B:
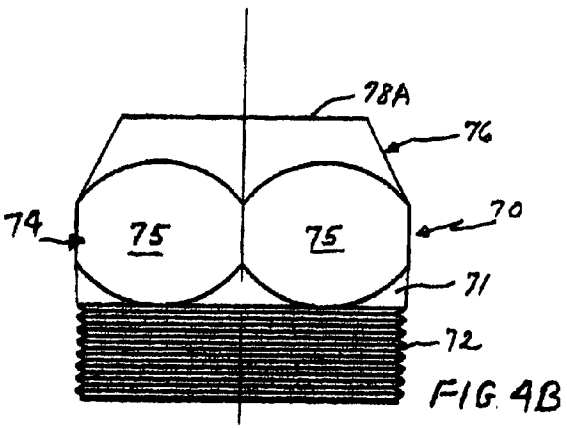
Figure 5A:
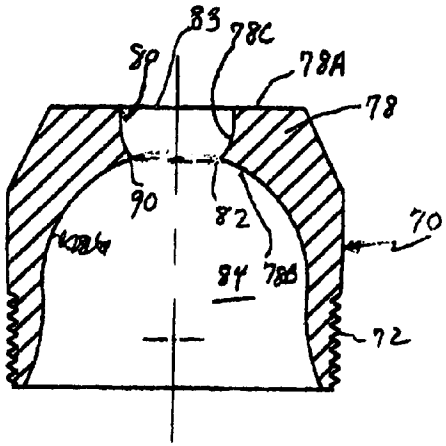
FIGS. 5A and 5B are cross-sectional illustrations of the nozzle shown in FIG. 4A taken along the section lines 5A—5A and 5B—5B, respectively.
Figure 5B:
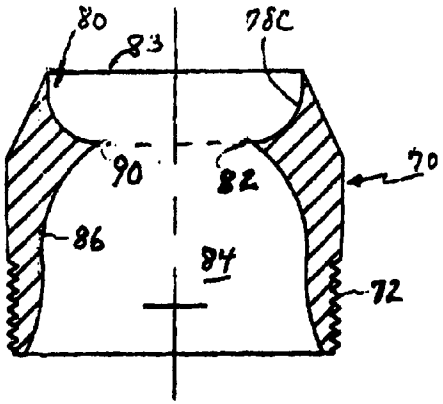

Now, in accordance with the present invention, it has been found that, by providing a different nozzle design, the snow-making efficiency of conventional snow-guns of the above-described type can be dramatically improved, e.g., by as much as 75%, and perhaps even more. As discussed below, the improved nozzle design reduces the opportunity for water particles to enlarge as they pass through the discharge nozzle. As shown in FIGS. 3. the snow-gun SG'of the invention is similar to that of the prior art snow-gun described above in that it comprises a cylindrical conduit 50 having a central passageway 50A adapted to receive and conduct air from a compressed air source (not shown), and a surrounding housing 52 that, together with the exterior surface of conduit 50, defines an annular passageway 52A adapted to receive water from a pressurized source of water (not shown). The end of conduit 50 supports a separate water-injection housing 54 which comprises a hollow cylindrical housing 56 having a plurality of equally-spaced water-injection holes 58 circumferentially-formed therein. Preferably, holes 58 are arranged in two linear arrays that are spaced apart axially by distance D of about 12 mm. Preferably, each hole 58 has a relatively large diameter of about 6 mm. Thus, compressed air passing through conduit 50 enters the interior of the water-injection housing through an expanding entrance throat 54A. and it exits through a contracting exit throat 54B which communicates with the interior of a mixing chamber housing 60. A blocking member 62' having a concave surface 62A is supported on the axis of housing 54 by a pair of rigid metal extensions 63 welded to the out-flow end of housing 54. Thus, the snow-gun operates in substantially the same manner as described above (in connection with the snow-gun shown in FIGS. 1 and 2) in producing a mixture of small water particles and air within the mixing chamber 60 defined by the forward housing 62 of the snow-gun. in fact, except for the features of its nozzle 70 (described below) which provides for the unexpected substantial increase in snow-gun performance and efficiency, the snow-gun SG'of FIG. 3 is of conventional design and has been commercially available from the assignee hereof with the nozzle configuration shown in FIG. 1. But, in accordance with the present invention, when nozzle 70 is used in combination with the configuration of snow-gun SG', the latter becomes an entirely different snow-gun, one capable of producing significantly more snow for a given amount of compressed air and water.

Referring now to the preferred details of nozzle 70 (e.g., as shown in FIGS. 4A, 4B, 5A and 5B), it may be appreciated that the side view (shown in FIG. 4B) of the nozzle is virtually identical to that of conventional nozzles. Like the nozzles of the prior art, nozzle 70 comprises a solid metal housing 71 (preferably stainless steel or brass) having a threaded end portion 72 that is adapted to be received by a threaded opening 60A formed in the forward end of the mixing chamber housing 60. Nozzle 70 further comprises a hexagonal middle portion 74 defining three pairs of opposing flats 75, each pair being adapted to be engaged by an open-ended wrench for the purpose of releasably securing the nozzle's threaded end portion 72 to the snow-gun housing 62. According to a preferred embodiment, the distance between opposing flats 75 is about 5.33 cm. The forward end 76 of the nozzle tapers towards a flat exterior forward surface 78A of the nozzle's end wall 78, best shown in FIG. 5A. A typical overall length of the nozzle is about 5.0 cm.

Now in accordance with the present invention, the nozzle's forward wall 78 differs significantly from that of the prior art nozzle in that it has a relatively large elliptical discharge port 80 (shown best in FIG. 4A) formed therein. Port 80 gradually expands in cross-sectional area through the thickness of wall 78, starting as a relatively small elliptical opening 82 at the interior surface 78B of end wall 78, and gradually expanding through the wall thickness to a larger elliptical opening 83. At the interior surface 78B of end wall 78, the smaller elliptical opening 82 is defined by an elliptical cusp 90, such cusp, in turn, being defined by the endless cusp line where the bottom of the inclined port wall 78C meets the concave interior surface 78B. While the smaller elliptical opening 82 may expand towards the larger elliptical opening 83 in accordance with a linear function, in which case the inclined port wall 78C between surfaces 78A and 78B will be planar (or straight) in shape, it is highly preferred that such expansion be determined by a non-linear function, whereby the expansion will initially proceed at a fast rate, followed by a gradually slowing rate. Such a non-linear function will give rise to a port wall 78C having a concave shape, as shown in the cross-sectional views of FIGS. 5A and 5B. Owing to this concave shape, ample clearance is provided about the elliptical opening 82 (forward of the cusp line 90) to allow the vast majority of the water particles exiting from the interior of the nozzle housing through opening 82 to reach the atmosphere without contacting the nozzle side wall 78C; thus, such particles are less likely to impinge upon the port wall and thereby reflect therefrom into contact with other particles which may give rise to an undesired enlarging of the particles. A preferred size for the larger elliptical opening 83 is one having a length L1 of about 4.57 cm., and a width W1 of about 2.11 cm. A preferred size for the smaller elliptical opening 82 is one having a length L2 of about 2.80 cm., and a width W2 of about 1.66 cm. A preferred area of the smaller ellipse 82 is about 0.56 square inches±0.1 square inch. A preferred area for the larger ellipse 83 is between about 2 to 3 times the area of the smaller ellipse. As suggested, the use of an elliptically-shaped opening is highly preferred over a circular opening that has been milled-out or otherwise enlarged to provide a similar clearance on the exit side of the opening. Why this approach does not provide comparable increases in efficiency is not understood. But, as the L1/W1 ratio of the opening 82 exceeds about 2.0, a dramatic increase in efficiency is noted. Further, as shown in the front view of FIG. 4A, it is more important to provide more clearance in one plane (e.g., the horizontal plane as shown) than in the perpendicular plane. That is, if equal clearance is provided uniformly about the elliptical opening 82, the efficiency is much less than if a much wider clearance is provided at the sides of the opening than at the top and bottom. Again, the reason why this "non-uniform" clearance configuration provides better results is not understood. It is suspected, however, that the provision of a uniform clearance about the entire opening will effect a significant drop in pressure of the air/water-particle mixture exiting from the nozzle, and that such a drop in pressure will enable water particles to recombine with others, thereby making it more difficult to achieve crystallization.

Using a snow-gun of the type shown in FIG. 3 with two different nozzles, one being the "conventional nozzle" shown in FIG. 1 and having a 1⅛ inch (28 mm.) diameter circular opening with a 25 mm. bore length, and the other being the "new nozzle" shown and described with reference to FIGS. 4A, 4B, 5A, and 5B, tests were conducted at various locations and under varying environmental conditions. The following test is illustrative of the improvement in energy efficiency resulting from the use of the new nozzle.

Test

Conditions: Ambient temperature=20 degrees F. (dry bulb); relative humidity=42%; water temperature=36 degrees F.; compressed air temperature=36 degrees F.; compressed air pressure=84 PSI; and water pressure=95 PSI.

| | Conventional Nozzle | New Nozzle |
|---|---|---|
| Compressed air, corrected (0.967) | 709.0 CFM | 348.0 CFM |
| Water Converted to Snow | 35.0 GPM | 29.8 GPM |
| Air/Water Ratio | 20.26:1 | 11.68:1 |
| KW air energy used | 124.4 KW | 61.4 KW |
| GPM of water/KW air energy used | 0.28 GPM | 0.49 GPM |
| Relative Energy Efficiency | 100% | 175% |

Figure 6:
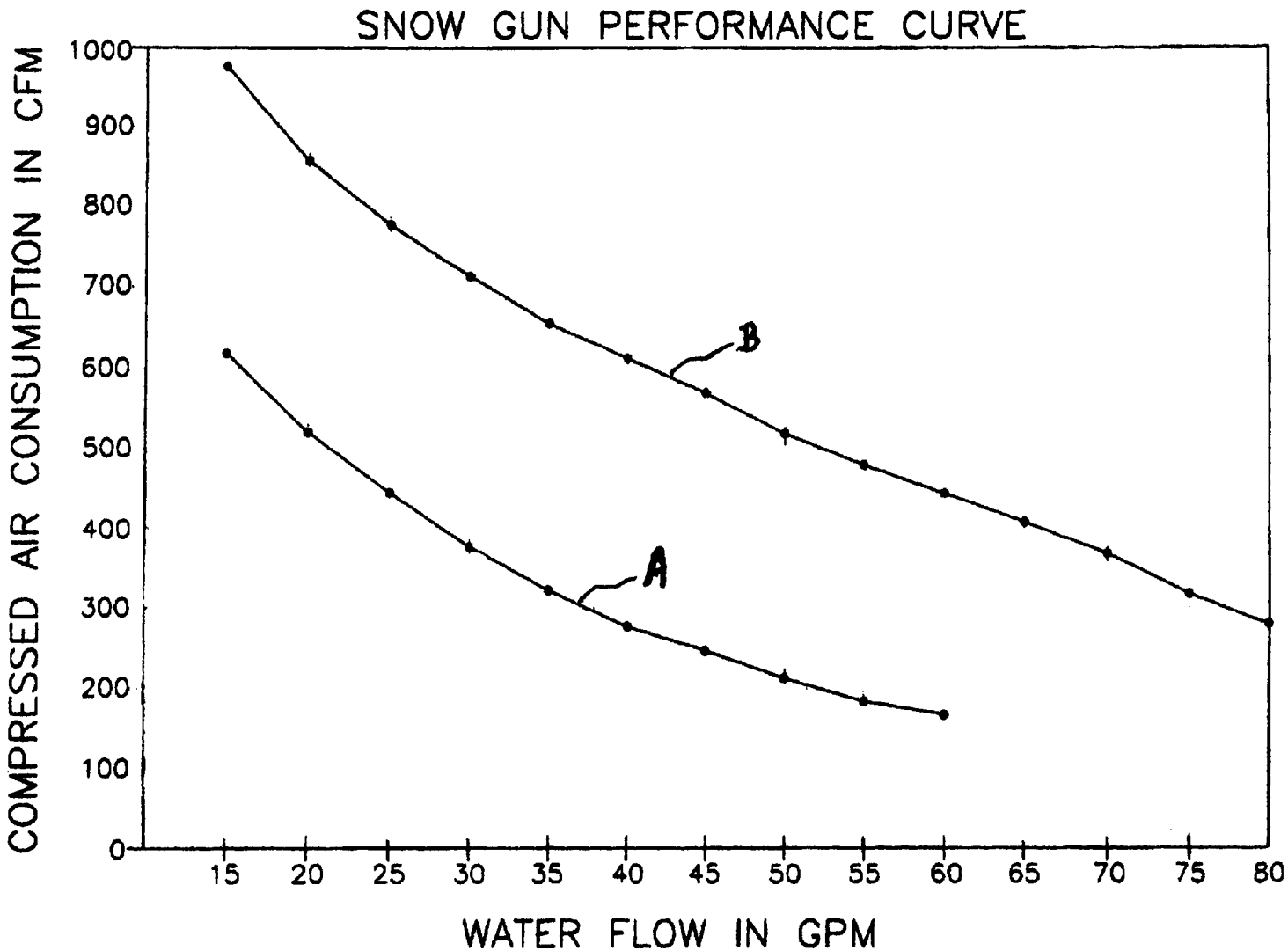
FIG. 6 is a graph illustrating the improved efficiency of the snow-gun of the invention vis-á-vis the conventional design.

It should be emphasized that the above test is merely exemplary of the improvement in efficiency achieved through the use of the new nozzle in combination with a snow-gun of the type described. The 75% improvement in efficiency produced by the new nozzle versus the prior art nozzle is simply the ratio of the gallons of water per kilowatt of compressed air energy used to produce a given quality of snow, using the prior art nozzle as the standard. The efficiency increase is dependent on the wetness of the snow, the wetter the snow, the greater the observed increase in efficiency. In the graph of FIG. 6, the two curves A and B depict the respective performances anticipated of two snow-guns, one equipped with the new nozzle of the invention (curve A) and one equipped with the above-noted prior art nozzle (curve B). The curves assume an air pressure of 90 PSI. As shown, the greater the water flow rate (in gallons-per-minute, GPU) through the nozzle, the less air flow through the gun (in cubic feet per minute, CPU). The air pressure applied to the gun is typically between 70 and 100 PSI, and the water pressure is typically between 50 and 130 PSI. It is preferred that the respective air and water pressures be within 40 PSI of each other to assure that one component does not shut-off the supply of the other. As the ambient temperature increases, the snow quality becomes wetter, requiring that the water flow rate be reduced to maintain a constant snow quality. For example, at an ambient temperature of 28 degrees F., the snow-gun of the invention may operate at a water flow rate of 25 GPM, at which water flow rate the compressed air consumption will be about 440 CFM, as derived from curve A. If the ambient temperature drops to, say 15 degrees F., making it easier to make snow, the water flow rate may be increased to, say 55 GPM, at which flow rate the air consumption may be reduced to 190 CFM. Referring to curve B, at the same two ambient temperatures, the prior art snow-gun (with the circular bore nozzle) requires considerably more compressed air, 780 CFM (versus 440 CFM with the new nozzle), and 480 (versus 190 CFM) to make snow of the same consistency. Thus, performance of the snow-gun of the invention, as represented by curve A, is far superior to the afore-noted prior art device, as represented by curve B.

From the foregoing description, it will be appreciated that a significant improvement has been made to the performance and efficiency of snow-guns of the type described above. Nozzle 70, by virtue of its elliptically-shaped discharge port and the clearance it provides for water-particles discharged through it, enables the water particles to exit the nozzle interior without substantially expanding in size and thereby becoming more difficult to crystallize.

The invention has been described in detail with respect to certain preferred embodiments. It will be understood, however, that changes can be made to the structure described without substantially departing from the spirit of the invention, and such changes are intended to fall within the scope of the appended claims.

What is claimed is:

1. A snow-gun for producing man-made snow from a mixture of air and water, said snow gun comprising:

(a) a first conduit comprising a first cylindrical wall defining a first passageway therein, said first conduit having (i) an entrance aperture at one end for admitting air into said first passageway from a compressed air source, (ii) an exit aperture at an opposite end through which air passing through said first passageway can exit from first conduit, and (iii) a plurality of holes circumferentially formed through said first cylindrical wall at a location proximate said exit aperture in the first conduit;

(b) a second conduit comprising a second cylindrical wall positioned about the first cylindrical wall of the first conduit to define a second passageway between the two conduits, such second cylindrical wall having a port therein for introducing water into the second passageway from a pressurized water source, such second passageway communicating with the first passageway only via the holes formed in the first cylindrical wall, whereby pressurized water within said second passageway is injected into an air stream passing through the first passageway in the form of water particles;

(c) a housing defining a mixing chamber connected to the first and second conduits for receiving an expanding mixture of air and water particles from the first passageway;

(d) a concave blocking member positioned within the mixing chamber at a position to break-up and thereby reduce the size of water particles entering the mixing chamber; and (e) a nozzle member connected to the mixing chamber housing for receiving a pressurized mixture of air and water particles from said mixing chamber, said nozzle member comprising a cup-shaped housing defined by a cylindrical wall and an end wall that encloses one end of said cylindrical wall, said end wall having formed therein an elliptically-shaped port through which air and water particles received by said nozzle member can be discharged into the surrounding atmosphere, said elliptically-shaped port having a transverse cross-sectional area, determined along and perpendicular to the central axis of the port, that gradually expands in size through the end wall thickness, in the direction in which the pressurized mixture of air and water particles is discharged from said nozzle, said transverse cross-sectional area expanding in size according to a non-linear function by which said area initially expands at a relatively fast rate followed by a gradually slower rate, whereby an endless concave wall is formed through the thickness of said end wall at a location that surrounds said elliptically-shaped port, said endless concave wall providing clearance for water-particles of said pressurized mixture discharged through said port so that said water-particles can pass through said port with minimal contact with said concave wall and with each other.

2. The apparatus as defined by claim 1 wherein said concave wall intersects the interior side of said end wall to define an endless elliptically-shaped cusp through which said pressurized mixture is discharged.

3. A snow-gun nozzle adapted for use in a snow-gun of the type comprising (a) a conduit for conducting a stream of air under pressure, (b) a water-particle-injecting portion for injecting water particles into said stream of air to produce a moving mixture of air and water-particles, (c) a blocking member positioned in the path of said moving mixture to engage said mixture for the purpose of reducing the size of said water-particles therein, and (d) a mixing chamber for containing said moving mixture after said mixture has engaged said blocking member, said nozzle comprising:

a cup-shaped housing defining a chamber adapted to receive a mixture of air and water particles from said mixing chamber, said housing being operatively connected to said mixing chamber and having a forward wall with a port formed therein through which said mixture can be discharged into the atmosphere, said port being elliptical in shape throughout the thickness of said forward wall and having a transverse cross-sectional area, determined along and perpendicular to the central axis of said port, that expands in size at a first rate followed by a gradually slower rate in the direction in which the air and water particles are discharged from said nozzle, whereby an endless concave wall is formed through the thickness of said end wall at a location that surrounds said elliptically-shaped port, said endless concave wall providing clearance for water-particles of said pressurized mixture discharged through said port so that said water-particles can pass substantially unimpeded through said port.

4. The apparatus as defined by claim 3 wherein said concave wall intersects the interior side of said end wall to define an endless elliptically-shaped cusp through which said pressurized mixture is discharged.

* * * * *